United States Patent [19]

Harvey et al.

[11] 4,286,784

[45] Sep. 1, 1981

[54] BOWLING PRACTICE DEVICE

[75] Inventors: Leslie E. Harvey, Mountain View; Stephan D. Spiva, Sunnyvale, both of Calif.

[73] Assignee: Carlos Enterprises, Menlo Park, Calif.

[21] Appl. No.: 56,804

[22] Filed: Jul. 12, 1979

[51] Int. Cl.[3] ..... A63B 69/00

[52] U.S. Cl. ..... 273/54 D; 273/48

[58] Field of Search ..... 273/48, 54 R, 54 D, 273/129 Q

[56] References Cited

U.S. PATENT DOCUMENTS

| | | | |
|---|---|---|---|
| 1,679,643 | 8/1928 | Baumann | 273/38 |
| 2,751,706 | 6/1956 | Metal | 273/157 R UX |
| 3,159,401 | 12/1964 | Ikenberry | 273/54 R |
| 4,046,376 | 9/1977 | Harvey et al. | 273/54 D |
| 4,097,045 | 6/1978 | Bechtel | 273/54 R |

*Primary Examiner*—Anton O. Oechsle

[57] ABSTRACT

A bowling practice device (1) is described comprising a a pair of inner rail members (2,3) and a pair of outer side wall safety members (7,8). The rail members (2,3) and the side wall members (7,8) are all interchangeable with each other. A plurality of cross members (12,13,14) are provided for supporting the rail members (2,3) and side wall members (7,8) in a relatively rigid spaced relationship. In use, a rolling bowling ball is received by the forward edge (4) of the rail members (2,3) and is caused to travel along a curved surface (6) extending rearwardly and upwardly from the forward surface (4) until the ball stops. When the ball stops, it is caused to return to the bowler. The side wall members (7,8) deflect a rolling ball rolled thereagainst toward the rail members.

15 Claims, 5 Drawing Figures

FIG. 2
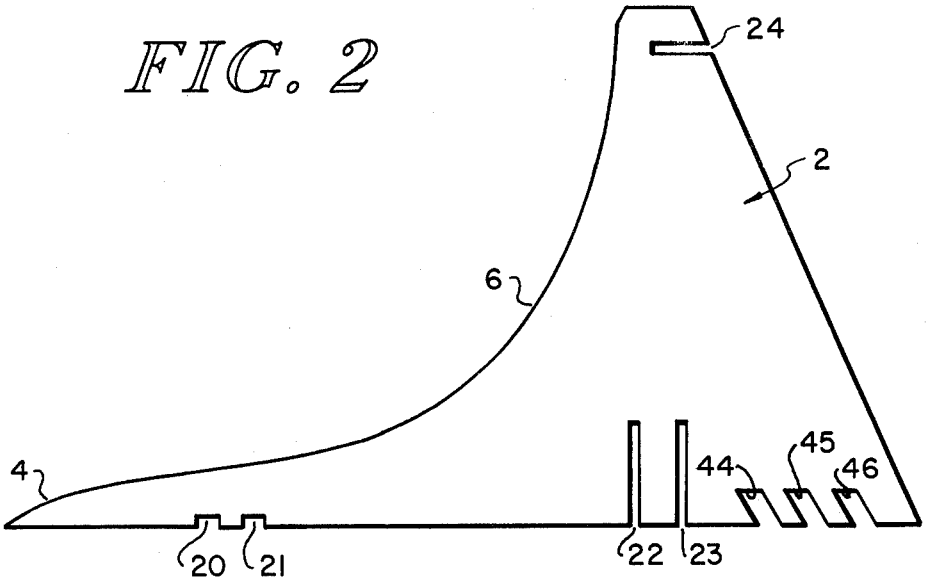
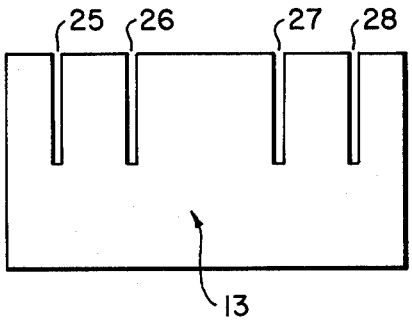
FIG. 3
FIG. 4
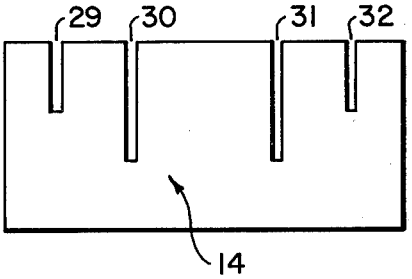
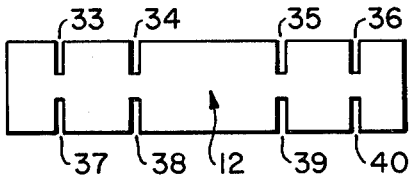
FIG. 5

BOWLING PRACTICE DEVICE

BACKGROUND OF THE INVENTION

The present invention is related to sporting equipment in general and in particular to a device for practicing bowling.

Heretofore, a person who desired to learn the game of bowling or to practice and improve certain skills in bowling, such as, for example, the foot movement, the swing, the release and the follow-through, has had to attend a conventional bowling alley. Frequently, the attending of a conventional bowling alley for the purpose of learning or practicing the game of bowling has a number of disadvantages. First, with the ever increasing interest in bowling, the bowling alleys are frequently being used for league bowling and are not readily available for practice bowling. The cost of bowling is also increasing with the ever increasing interest in bowling such that the cost of practicing at conventional bowling alleys is becoming prohibitive. Also, it is not always necessary to knock pins down to learn, practice and improve certain skills in the sport. For these reasons, an apparatus for learning and practicing the sport of bowling at home is desirable and advantageous.

In U.S. Pat. No. 4,046,376, issued to the applicants on Sept. 6, 1977, there is disclosed and claimed a bowling practice device which has many of the advantages and features desired in these types of devices. It is relatively small in size, light in weight and portable. It can be used in the living room on a living room rug or the like. It intercepts a rolling bowling ball and returns it to the bowler. As described in the patent, the operative surface of the device comprises a ramp with a concave, upwardly sloping inclined surface and a pad located at the top of the ramp for stopping the forward motion of the bowling ball and causing the ball to roll in a reverse direction down the ramp and toward a bowler.

While certainly useful for the purpose intended, the prior patented bowling practice device is found to be expensive to manufacture and ship in that the various parts, including supporting side, bottom and rear members are not interchangeable and require a considerable amount of packing and storage space when disassembled for shipping and storage. These factors make the apparatus costly to manufacture, package and ship.

SUMMARY OF THE INVENTION

In view of the foregoing, a principal object of the present invention is a bowling practice device comprising a plurality of interchangeable parts which are relatively inexpensive to manufacture, light in weight, easily packaged and shipped and easy to assemble and disassemble.

Another object of the present invention is a bowling practice device as described above which intercepts a rolling bowling ball and returns it to the bowler.

In accordance with the above objects there is provided a plurality of identical panel members, each having a curved surface for forming a pair of rail members and a pair of side wall safety members and a plurality of supporting cross members for supporting the rail and side wall members in a spaced relationship. For packing and shipping, the panel and cross members, when disassembled, form a relatively flat, compact package. When assembled, the members form a relatively rigid, lightweight, highly stable bowling practice apparatus. Assembly and disassembly of the members is quick and easy.

DESCRIPTION OF THE DRAWING

The above and other objects, features and advantages of the present invention will become apparent from the following detailed description of the accompany drawing in which:

FIG. 2 is a side elevation view of one of the rail and side wall members of the apparatus of FIG. 1.

FIG. 3 is a plan view of the rear base supporting cross member of the apparatus of FIG. 1

FIG. 4 is a plan view of the rear top supporting cross member of the apparatus of FIG. 1.

FIG. 5 is a plan view of a forward base supporting cross member of the apparatus of FIG. 1.

DETAILED DESCRIPTION OF THE DRAWING

Figure 1:
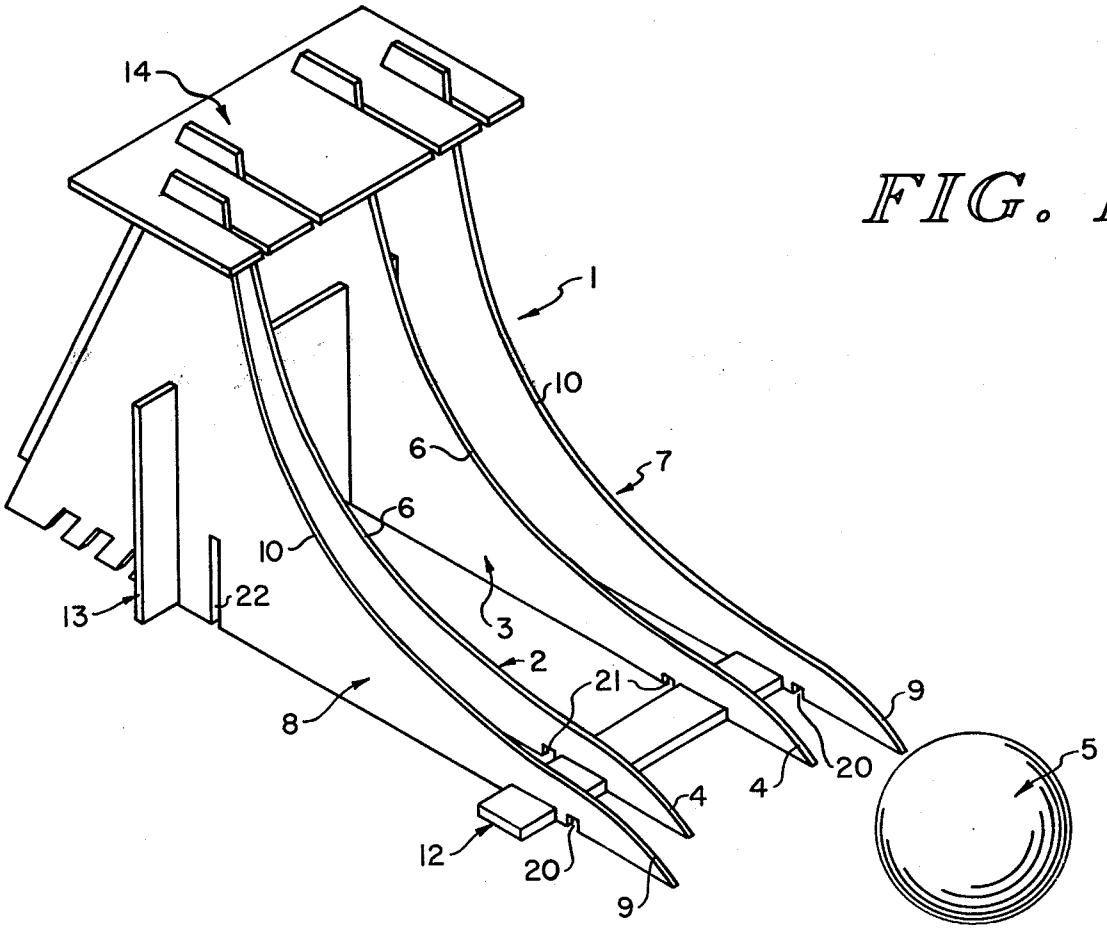
FIG. 1 is a perspective view of a bowling practice apparatus according to the present invention.

Referring to the drawing, and in particular to FIG. 1, there is provided in accordance with the present invention a bowling practice device designated generally as 1. In the bowling practice device 1 there is provided a pair of spaced, curved rail members designated generally as 2 and 3. Each of the rail members 2 and 3 has a forward edge 4 for initially receiving a rolling bowling ball, designated generally as 5 and a curved surface 6 extending rearwardly and upwardly from the forward edge 4 for stopping the forward motion of the ball and providing a return of the ball to the bowler. Located outside each of the rail members 2 and 3 there is provided a pair of side wall members designated generally as 7 and 8. The side wall members 7 and 8 have a forward edge 9 and a curved surface 10 extending rearwardly and upwardly from the forward edge 9 for directing a ball rolled thereagainst inwardly toward the rail members 2 and 3.

For supporting the rail members 2 and 3 and the side wall members 7 and 8 there is provided a plurality of supporting cross members 12, 13 and 14. The cross members 12, 13 and 14 are provided for supporting the rail members 2 and 3 and the side wall members 7 and 8 in a predetermined space relationship. One of the important features of the present invention is that by using the cross members 12, 13 and 14, it is possible to construct the apparatus of the present invention using identical interchangeable members for the rail members 2 and 3 and the side wall members 7 and 8.

Referring to FIG. 2, there is shown in side elevation one of the rail members 2 and 3 and side wall members 7 and 8. Because the rail members 2 and 3 and the side wall members 7 and 8 are identical, only one of the members—namely, rail member 2—is described.

As seen in FIG. 2, there is provided in the rail member 2 in the forward end of the base thereof a pair of slots 20 and 21 and in the rear end of the base thereof a pair of slots 22 and 23 and in the rear near the top of the member 2 a slot 24. The curved surface 6 has a relatively shallow slope near the front of the member 2 and a smooth transition to a large slope approaching a vertical line at the rear upper end thereof.

Referring to FIG. 3, there is provided in the cross member 13 a plurality of slots of equal depth 25, 26, 27 and 28.

Referring to FIG. 4, there is provided in the cross member 14 a plurality of slots 29, 30, 31 and 32. The slots 30 and 31 are deeper than the slots 29 and 32 by a predetermined amount for positioning the side wall members 7 and 8 forward of the rail members 2 and 3. The magnitude of the amount is determined by the amount it is desired to displace the side wall members 7 and 8 forwardly of the rail members 2 and 3. In a typical embodiment, this displacement is approximately one to three inches.

Referring to FIG. 5, there is provided in the cross member 12 a plurality of slots of equal depth 33, 34, 35, 36, 37, 38, 39 and 40.

To assemble the apparatus, the cross members 12 and 13 are positioned such that the section of the cross member 12 between the inner slots 34 and 38 and 35 and 39 and the inner slots 26 and 27 of the cross member 13 are fitted, respectively, in the forward slots 20 and 22 of the members forming the interior rail members 2 and 3. Similarly, the section of the cross members 12 between the outer slots 33 and 37 and 36 and 40 and the outer slots 25 and 28 of the cross members 13 are fitted, respectively, in the rear slots 21 and 23 of the members forming the outer side wall members 7 and 8. In this fashion, the outer side wall members 7 and 8 are positioned forwardly of the interior rail members 2 and 3 by an amount determined by the distance between the slots 20 and 21 and 22 and 23. This distance is also reflected in the different depths of the slots in the cross member 14. The difference in the depth of the slots 29 and 32 and 30 and 31 in the cross member 14 corresponds to the distance between the slots 20 and 21 and 22 and 23 for engaging the slot 24 in the upper end of the members 2 and 3 and 7 and 8 for supporting the upper end of the members. In locating the outer side wall members 7 and 8 forward of the rail members 2 and 3, the forward location serves to provide an elevated surface on the members 7 and 8 relative to the upper surface of the rail members 2 and 3. This provides for directing a ball rolled thereagainst inwardly toward the rail members 2 and 3.

In each of the members 2 and 3 and 7 and 8, there is provided in the base near the rear end thereof a plurality of slots 44, 45 and 46. The slots 44, 45 and 46, together with the rear edge of the members 2, 3, 7 and 8 and the lower rear edge of the cross members 12 and 13, provide engaging means for engaging the surface such as a rug on which the apparatus is supported for resisting movement of the apparatus relative to the surface when the apparatus is impacted by a bowling ball.

In a typical embodiment of the apparatus, the depth of the apparatus from the forward to the rear edge thereof is approximately 36 inches. The height of the apparatus from the base to the top thereof is approximately 30 inches. The spacing between the rail members 2 and 3 is less than the diameter of the bowling ball 5 and, in a typical embodiment, is approximately one-half to threequarters of the diameter of the bowling ball 5. The location of the side wall members 7 and 8 is from two to five inches outside of the rail members 2 and 3. Because of the relatively rigid construction provided by the cross members 12, 13 and 14 and the rail and side wall members 2, 3, 7 and 8, the various pieces of the apparatus may be made from any of a variety of materials including wood and plastic. Plastic is typically the preferred material because it generally weighs less, is easier to obtain and less expensive than wood. The shape of the curved surfaces 6 of the rail members 2 and 3 and 10 of the side wall members 7 and 8 is chosen to convert most efficiently the kinetic energy of the forward motion of a rolling bowling ball to potential energy. Accordingly, the size and shape of the curved surfaces are chosen such as to avoid the necessity under normal circumstances for any type of padded buffer or the like.

In use, the apparatus may be supported on a living room carpet or the like. After the apparatus is properly positioned on the carpet, the user stands from 5 to 10 feet in front of the apparatus and rolls a bowling ball toward the apparatus. As the user rolls the bowling ball toward the apparatus, notice is taken of the delivery and release of the ball. As the ball impacts the apparatus, it is carried rearwardly and upwardly by the curved surfaces 6 of the rail members 2 and 3. As the ball continues to travel upwardly on the rail members 2 and 3, its forward motion is arrested and ultimately it stops and rolls back to the bowler. If, by chance, the bowler inadvertently misses the mark and strikes either of the side walls 7 and 8, the ball is deflected toward the rail members 2 and 3.

An embodiment of the invention is described. It is contemplated, however, that various modifications and changes may be made without departing from the spirit and scope of the invention. For example, the shape of the curved surfaces 6 and 10 may be varied and the shape and size of the cross members 12, 13 and 14 may be changed to accommodate specific applications and designs. Accordingly, it is intended that the scope of the invention not be limited to the embodiment described but rather be determined by the claims hereinafter provided and their equivalents.

What is claimed is:

1. A practice bowling apparatus comprising: means for intercepting a rolling bowling ball and returning it to the bowler, said intercepting means comprising a pair of spaced curved rail members, the spacing between said rail members being less than the diameter of said bowling ball and means for deflecting a ball moving laterally from said rail members toward said rail members.

2. An apparatus according to claim 1 wherein each of said curved rail members comprises a forward edge for initially receiving said rolling ball and a curved surface extending rearwardly and upwardly therefrom for stopping the forward motion of said ball and providing said return of said ball to said bowler.

3. An apparatus according to claim 1 comprising means for resisting movement of the apparatus relative to a surface on which said apparatus is supported when said apparatus is impacted by said bowling ball.

4. An apparatus according to claim 2 wherein said deflecting means comprises a pair of side wall members and means for supporting one of said side wall members outside of each of said rail members for directing a ball rolled thereagainst inwardly toward said rail members.

5. An apparatus according to claim 3 wherein said means for resisting movement of the apparatus relative to a surface on which said apparatus is supported comprises means for engaging said surface when said apparatus tends to move relative thereto.

6. An apparatus according to claim 4 wherein said rail members and said side wall members have the same size and shape and said means for supporting said side wall members comprises means for supporting said side wall members a predetermined distance forward of said rail members, said forward location of said side wall members serving to provide an elevated surface relative to the upper surface of said rail members for providing said directing of said ball rolled thereagainst inwardly toward said rail members.

7. An apparatus according to claim 5 wherein said engaging means comprises means extending from the bottom of said apparatus.

8. An apparatus according to claim 4 wherein said supporting means comprises means for interchanging said rail and side wall members.

9. An apparatus according to claim 7 wherein said engaging means comprises a plurality of relatively sharp edges.

10. An apparatus according to claim 8 wherein said interchanging means comprises a plurality of slots in said rail and side wall members and a plurality of supporting cross members each of which is provided with a plurality of slots for interlocking with corresponding ones of said slots in said rail and side wall members.

11. An apparatus according to claim 10 wherein said plurality of slots in each of said rail and side wall members comprises a first pair of slots in the base of each of said members near the forward end thereof, a second pair of slots in the base of each of said members near the rear end thereof and a slot in the rear of each of said members near the top end thereof and said plurality of slots in each of said cross members comprise a first set of slots in a first of said cross members for interlocking with said first pair of slots in said rail and side wall members, a second set of slots in a second of said cross members for interlocking with said second pair of slots in said rail and side wall members and a third set of slots in a third of said cross members for interlocking with said slot near the top end of each of said rail and side members.

12. An apparatus according to claim 1 wherein said deflecting means comprises a side wall member.

13. An apparatus according to claim 12 wherein said side wall member comprises means located adjacent to a lateral edge of one of said rail members.

14. A practice bowling apparatus comprising: means for intercepting a rolling bowling ball and returning it to the roller thereof, said intercepting means comprising a pair of spaced rail members each having a ball receiving surface which is curved rearwardly and upwardly from the forward lower end thereof over substantially its entire length.

15. An apparatus according to claim 13 wherein the upper end of said curved surface approaches a substantially vertical direction.

* * * * *